US005879270A

United States Patent [19]

Huish et al.

[11] Patent Number: 5,879,270

[45] Date of Patent: Mar. 9, 1999

[54] HEART RATE INTERVAL CONTROL FOR CARDIOPULMONARY INTERVAL TRAINING

[75] Inventors: Dennis Copen Huish, Irvine; Kirk A. Buhler, Corona, both of Calif.

[73] Assignee: Unisen, Inc., Tustin, Calif.

[21] Appl. No.: 920,223

[22] Filed: Aug. 25, 1997

Related U.S. Application Data

[60] Provisional application No. 60/043,748 Apr. 9, 1997.

[51] Int. Cl.[6] ..... A63B 21/005

[52] U.S. Cl. ..... 482/8; 482/1; 482/3; 482/9; 482/54; 482/900

[58] Field of Search ..... 482/1–9, 54, 57, 482/900, 902; 601/23, 33–36

[56] References Cited

U.S. PATENT DOCUMENTS

| | | |
|---|---|---|
| 5,067,710 | 11/1991 | Watterson et al. . |
| 5,462,504 | 10/1995 | Trulaske et al. . |
| 5,527,239 | 6/1996 | Abbondanza . |

FOREIGN PATENT DOCUMENTS

| | | |
|---|---|---|
| 0 255 621 A | 2/1988 | European Pat. Off. . |
| 0 379 227 A | 7/1990 | European Pat. Off. . |

*Primary Examiner*—Glenn E. Richman
*Attorney, Agent, or Firm*—Knobbe, Martens, Olson & Bear, LLP

[57] ABSTRACT

Cardiopulmonary interval training between a user high target heart rate and a user low target heart rate is obtained with an exercise apparatus by increasing the load of the exercise apparatus at a first predetermined rate until either the maximum machine load is obtained or the high target heart rate. When this event occurs, the load can then be maintained at a fixed level for a predetermined time. Thereafter, the load is decreased until the low target heart rate is obtained, or the user-set exercise duration expired. The heart rate of the user is monitored during the exercise. In the event that measurement of a valid heart signal is lost at any time, any increase or decrease of the load of the exercise apparatus is terminated until a valid heart rate signal is reacquired. In the case when an exercise apparatus is a treadmill, the load can be varied by increasing or decreasing both the speed adjustment and the elevation adjustment of the treadmill. In the preferred embodiment, the speed is first adjusted until a user-set maximum speed is obtained and thereafter the elevation is adjusted in order to obtain the load variations toward or from the high and low target heart rates. The exercise may be repeated between the low and high target heart rates to provide cardiopulmonary interval training.

21 Claims, 7 Drawing Sheets

| FIG. 5A | FIG. 5B |
|---|---|

HEART RATE INTERVAL CONTROL FOR CARDIOPULMONARY INTERVAL TRAINING

This application claims benefit of provisional application Ser. No. 60/043,748, filed Apr. 9, 1997.

BACKGROUND OF THE INVENTION

1. Field of the Invention

This invention relates to improvements in the control of exercise machines utilizing interval training based on detecting a user's heart rate.

2. Description of the Related Art

The monitoring of heart rates for use on exercise equipment of all kinds, vertical bicycles, recumbent bicycles, steppers, treadmills, rowing machines and the like is well known. Typically, the exercise rate of the user is maintained according to a preset or calculated heart rate. The heart rate often is set based upon the user's age, weight and sex.

The user begins the exercise cycle by entering a warm-up period for a predetermined amount of time during which the exercise rate is not controlled by the actual monitored heart rate, other than perhaps a maximum limit. After the warm-up period, the user then increases the exercise rate or load, while the heart rate is monitored. The load may be varied according to various types of algorithms as the target heart rate is approached. Once the target heart rate is achieved, the load is thereafter varied to maintain the heart rate for a predetermined time or amount of exercise. Thereafter, a cool-down exercise period is performed at lower exercise rates or loads during which the heart rate is allowed to decrease.

However, it is appreciated by athletes that physical fitness training is more effectively reached by interval training. Interval training can, in general, be described as exercise at periodically higher and lower rates in a cyclic or repetitive pattern so that physical endurance is built up. Such interval training is based upon a cyclic pattern of physical exercise rates or exercise loads without regard to cardiopulmonary function, but is more directly concerned with the exercise and strengthening of skeletal muscle.

SUMMARY OF THE INVENTION

The present invention recognizes that the same salutary benefits of interval training to skeletal muscle might be achievable in cardiopulmonary fitness if a means were provided by which heart activity, typically heart rate, could be used as the interval training parameter for controlling the exercise. Cardiopulmonary interval training becomes practical in the situation in which a stationary exercise machine can be utilized, such as a bicycle, stepper, treadmill, rowing machine and the like, where the exerciser remains fixed at a single location so that the cardiopulmonary function can be practically measured and the exercise environment responsively controlled in a manner to force the user to perform the cardiopulmonary regimen required by the interval training.

Accordingly, the present invention provides, in one embodiment, a method for cardiopulmonary interval training with an exercise apparatus having a controllable load comprising the steps of determining a low target heart rate and determining a high target heart rate. A user's heart rate is measured. The load provided by the exercise apparatus is increased to the user while the user's heart rate is simultaneously measured. Increase of the load is limited by the high target hear rate. The load provided by the exercise apparatus to the user is decreased while simultaneously measuring the user's heart rate. Decrease of the load is limited by the low target heart rate. As a result, interval training is obtained between the high and low target heart rates.

In another embodiment, the present invention provides an exercise treadmill, exercise bicycle or other exercise machine automatically controlled to cause the user's heart rate to alternately move higher and lower to provide an interval training or "sprint" workout. The system includes a microprocessor programmed to automatically operate an exercise machine so that the user's heart rate is caused to move within an interval between a lower heart rate and an upper heart rate. The program automatically makes adjustments to alternately increase and decrease the user's heart rate, providing an Interval Training Workout directed by the user's heart rate.

In another embodiment, a preprogrammed microprocessor makes treadmill changes every 20 seconds, guided by the user's detected heart rate. If the heart rate signal is lost during the programmed control, it will hold the speed and the incline steady until the heart rate is again received (or, until manual changes are keyed in by the user). Speed is incrementally increased to "HI SPEED" (2.0 to 5.0 mph), followed by incline increases from 0 to 14%.

These and other advantages and embodiments of the present invention will be readily apparent to those skilled in the art having reference to the detailed description of the preferred embodiments and drawings herein, the invention not being limited, however, to any particular preferred embodiment described.

DETAILED DESCRIPTION OF THE PREFERRED EMBODIMENTS

The present invention is directed to a method and apparatus for controlling an exercise machine to establish a lower and upper heart rate limit and to make adjustments to the machine on a periodic basis in order to oscillate the user's heart rate between the two limits until the user completes a predetermined exercise set. In one embodiment, cardiopulmonary interval training between a user high target heart rate and a user-set low target rate is obtained with an exercise apparatus by increasing the load of the exercise apparatus at a first predetermined rate until either the maximum machine load is obtained or the high target heart rate. When this event occurs, the load is then maintained at a fixed level for a predetermined time. Thereafter, the load is decreased until the low target heart rate is obtained, or the user-set exercise duration expired. The heart rate of the user is preferably continuously monitored during the exercise.

In the event that measurement of a valid heart signal is lost at any time, any increase or decrease of the load of the exercise apparatus is terminated until a valid heart rate signal is reacquired. In the case when an exercise apparatus is a treadmill, the load can be varied by increasing or decreasing both the speed adjustment and the elevation adjustment of the treadmill. In the preferred embodiment, the speed is first adjusted until a user-set maximum speed is obtained and thereafter the elevation is adjusted in order to obtain the load variations toward or from the high and low target heart rates. The exercise may be repeated between the low and high target heart rates to provide cardiopulmonary interval training.

Figure 1:
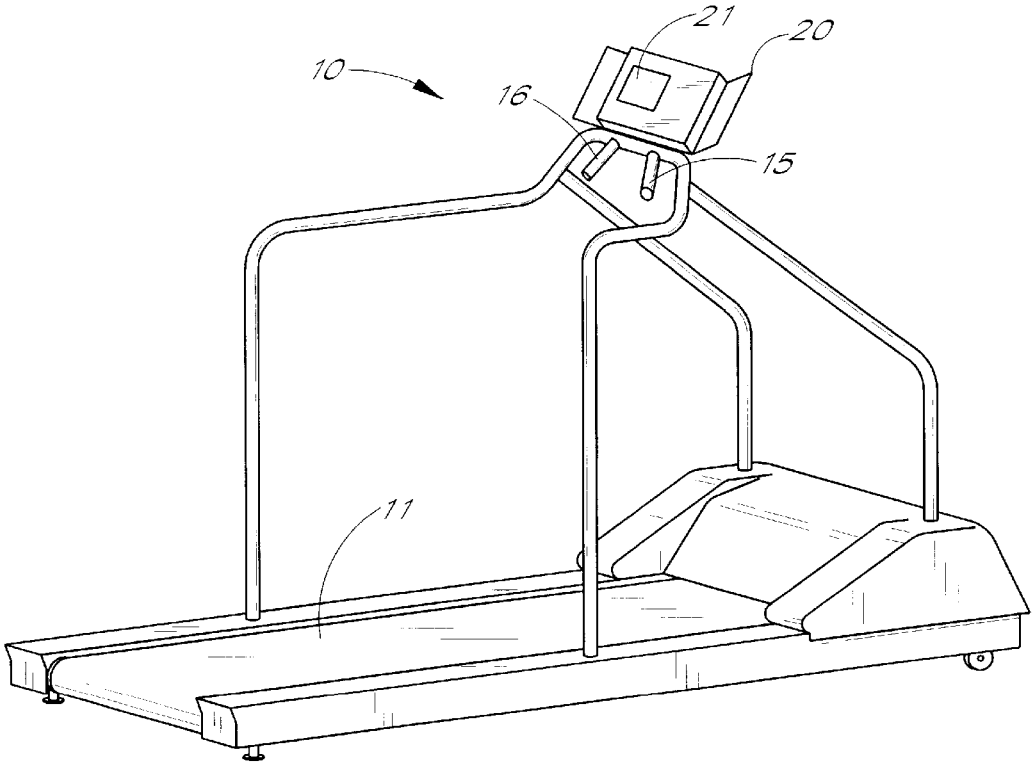
FIG. 1 is a perspective view of a treadmill exercise machine incorporating features of the present invention.
Figure 6:
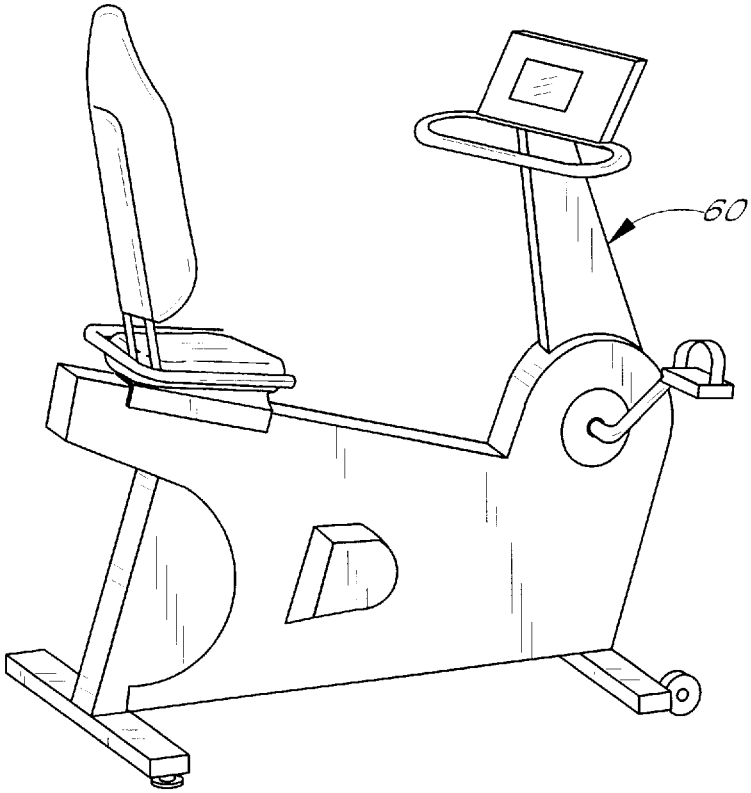
FIG. 6 is a perspective view of a bicycle exercise machine incorporating features of the present invention.

FIG. 1 illustrates an exercise treadmill 10 in which a running/walking endless belt 11 is automatically controlled to cause the user's heart rate to alternately move higher and lower. By way of specific example, it has been found that a "sprint" type of workout is very beneficial in which the user's heart rate is caused to alternately rise for 20 seconds and lower for 20 seconds. While a treadmill exercise machine is shown for purposes of illustration, it is to be understood that the type of exercise and the exercise equipment and the type of load and means by which such load may be provided to the user is entirely arbitrary, limited only by consistency with the following teachings. Therefore, upright or recumbent bicycles (see e.g., FIG. 6), steppers, treadmills, rowing machines, weight lifting apparatus and exercise equipment of all and any type by which a user in any condition, fit or handicapped, may elevate his or her cardiopulmonary function, is contemplated expressly as within the scope of the invention.

Figure 2:
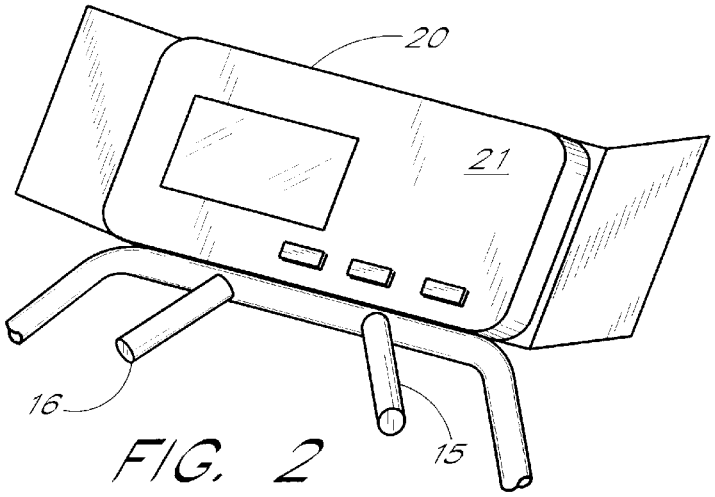
FIG. 2 is an enlarged view of the control panel display and hand-grip heart rate detector shown in FIG. 1.

As shown in FIGS. 1 and 2, the treadmill 10 includes a pair of right hand and left hand handgrips 15, 16 which have built-in detectors (not shown) for detecting the user's heart rate when grasped by the user. The means by which the heart rate is monitored is not restricted in any particular manner as long as it is consistent with the teachings presented here. For example, the heart rate may be monitored through any type of pressure transducer, which detects pulse or respiration rates, or both, attached or coupled at any place on the user's body or by electrophysiological means, whereby the electrocardiographic signal from the user is communicated continuously or intermittently to the control unit of the machine. As heart rate monitoring technology will no doubt improve in the future, any means now known or later devised by which heart rate signals can be discriminated from other signals and noise may be utilized. Alternatively, the user's heart rate may be detected by a chest strap heart rate detector which is in wireless communication with a receiver connected to the microprocessor 25. The treadmill 10 further includes a control and readout display unit 20, the face 21 of which is shown in enlarged detail in FIG. 3, described later.

Figure 4:
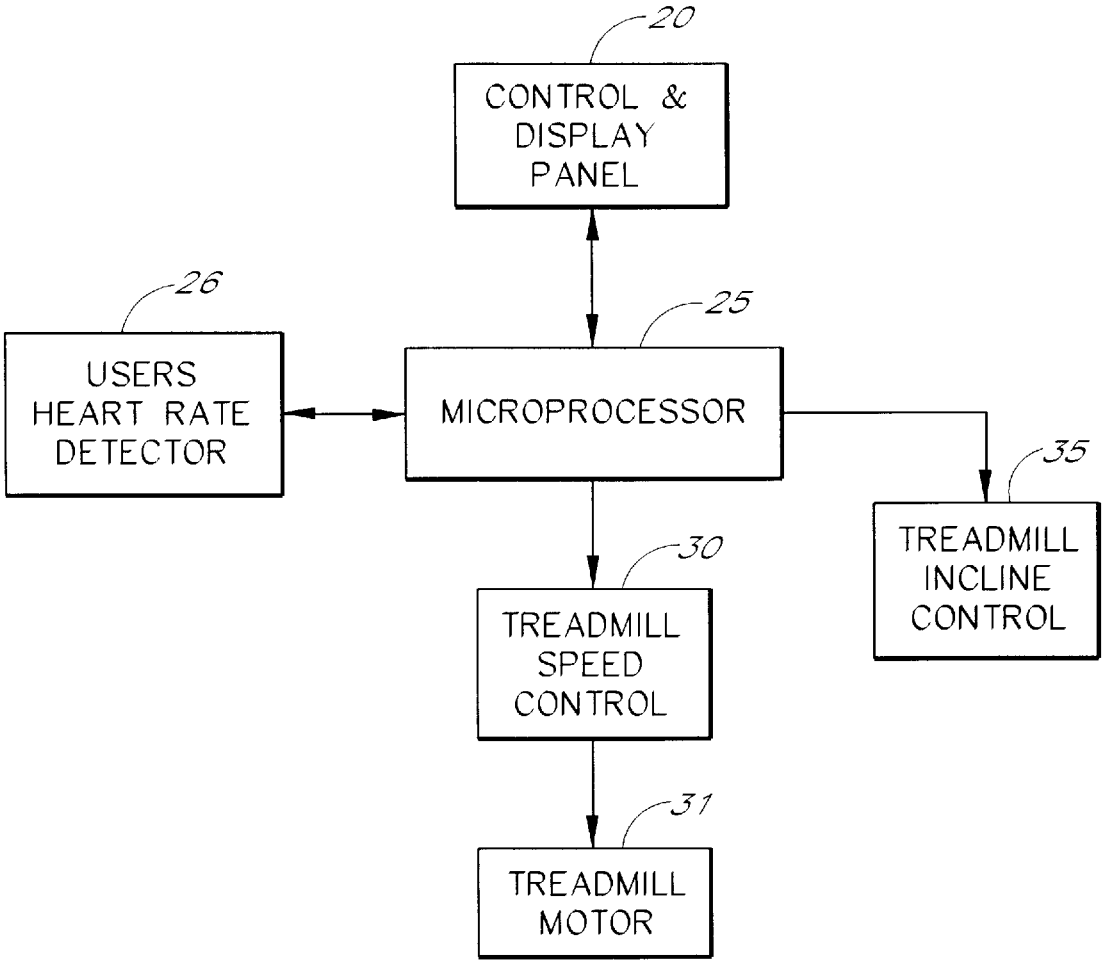
FIG. 4 is a block diagram of a heart rate interval control training system having features of the invention.

The overall control system employed in the preferred embodiment of the invention is shown in the schematic block diagram of FIG. 4. The control and panel display unit 20 is coupled to a programmed microprocessor 25 to both supply information to the microprocessor 25 from unit 20 and display information generated by the microprocessor 25. In addition, heart rate receiver detector 26, responsive to the heart rate detected by the hand grips 15 and 16 or the chest strap heart detector, supplies the user's heart rate count to the microprocessor. This microprocessor 25 is operatively coupled to the treadmill speed control 30 which drives the treadmill motor 31 and endless belt 11 (FIG. 1). In addition, the microprocessor 25 is operatively coupled to the treadmill incline control 35 to raise and lower the incline of the endless belt 11.

Figures 5, 5A:
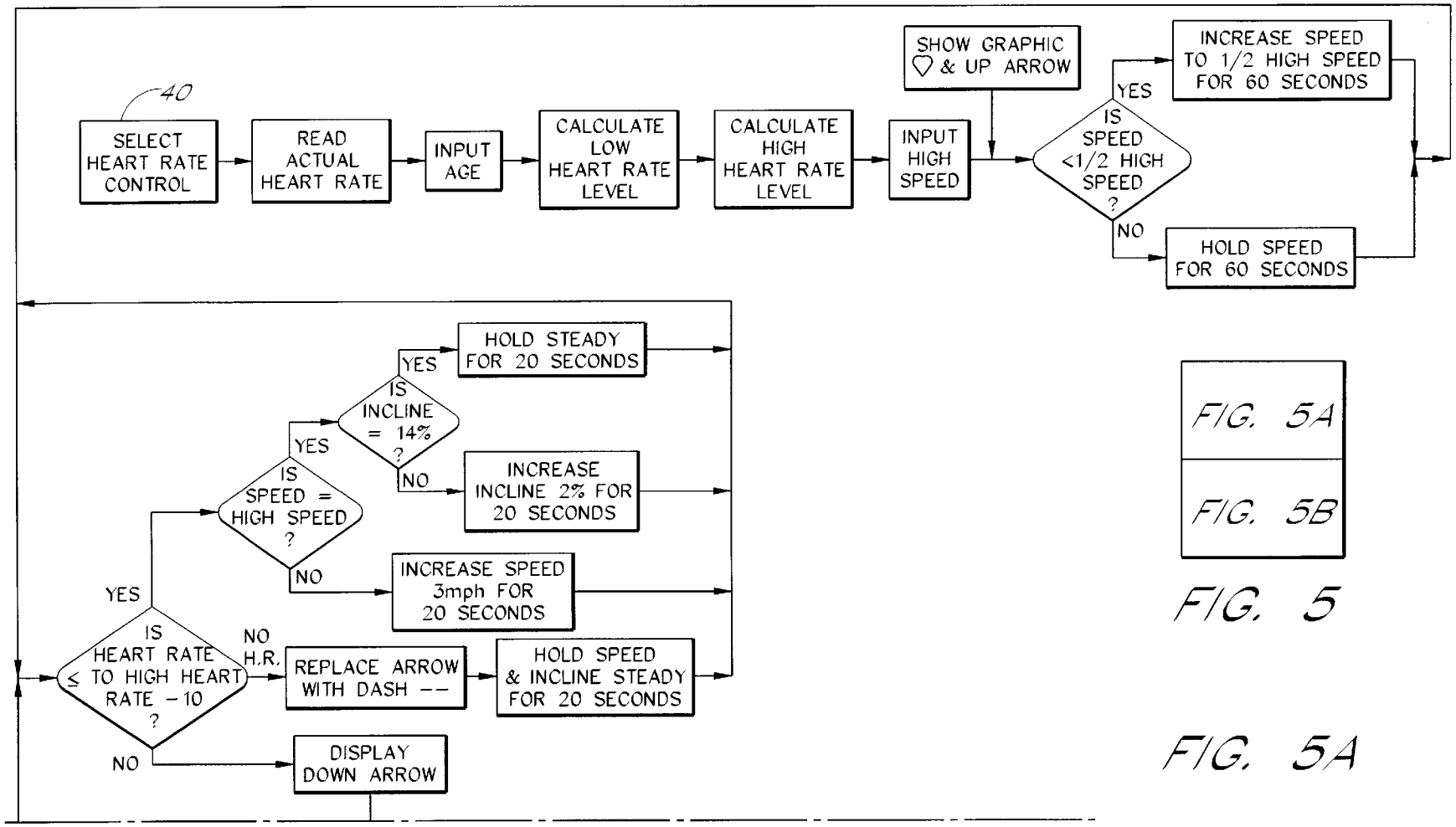
FIG. 5 illustrates a flow chart showing the operation of a programmed microprocessor in accordance with one embodiment of the present invention.
Figure 5B:
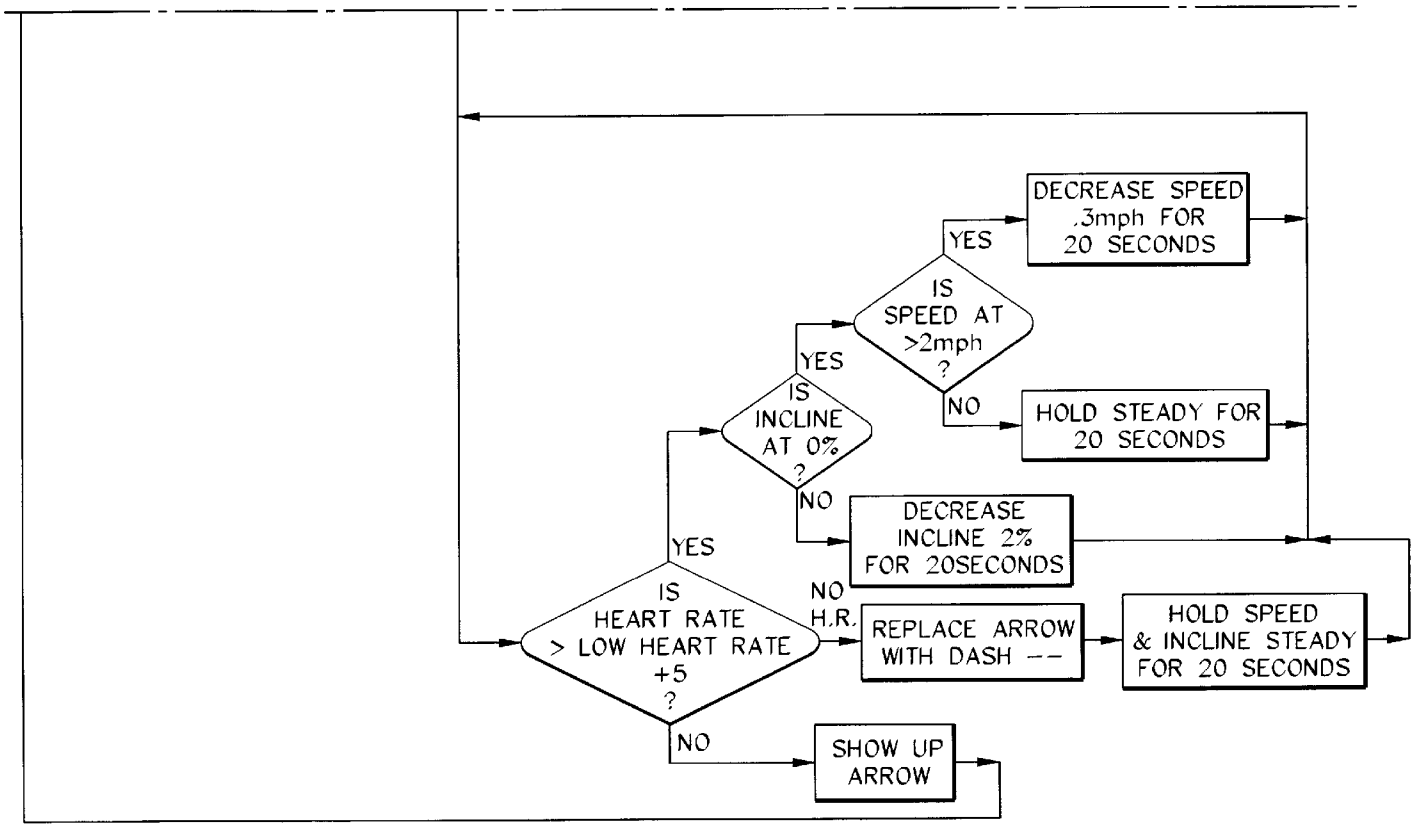

FIG. 5 illustrates a flow chart showing the operation of the programmed microprocessor 25 in accordance with one preferred embodiment of the present invention. The preferred operation of the programmed microprocessor 25 and display unit 20 to provide interval cardiopulmonary training is described below by way of example and having reference to the flow chart of FIG. 5 and the preceding FIGS. 1–4.

EXAMPLE 1

Treadmill Operation

SELECTING HEART RATE INTERVAL CONTROL

1. User presses the HEART RATE (HR) key 40 at ANY time. Existing workout speed and incline hold steady.
2. Display 21 will show "1=HEART RATE" for 2 sec, then "2=HR CONTROL" for 2 sec, and repeat the cycle until a selection is made. A 16 sec timeout returns to the existing program.
3. Pressing "1" will display the standard heart rate prompts and heart rate continuously, until HEART 40 is pressed again (off). If in HR Control program, actual (no smart heart) will be displayed.
4. Pressing "2" will display the standard heart rate prompts, and show the actual heart rate for 6 sec. If no heart rate signal is detected from heart rate detectors 26, the display will show "HRT RATE -- -- --" for 4 sec, and return back to the existing workout.
5. The program will display "AGE=". The user will press the numeric keys 44 on Panel 21 and press enter or time out and accept the entry. The programmed microprocessor 25 will calculate a "60%" LOW HR default value from: (220−AGE)×60%. If no age is given within 9 sec, the program default will instead use the actual heart rate subtracting 10 bpm (acceptable LOW HR values are 90 to 160 bpm.). If the heart rate was 110, for example, the display would show "LOW HR=100."
6. The LOW HR value "100" initially flashes (½ sec on and ½ sec off) for 6 sec, and steady for 3 sec. User adjusts the value using +/− (up/down) keys 45, 46 or 0–9 keys. User presses ENTER, or 9 sec total timeout accepts display value. SHIFT key has no response. HEART will exit to the existing workout.
7. The program calculates the "75%" HIGH HR default value from LOW HR×1.25. The value initially flashes for 6 sec, and steady for 3 sec. User adjusts the value using +/− keys or 0–9 keys 44. Acceptable HIGH HR values are 110 to 180beats per minute (bpm). The minimum difference between the limits is 20 bpm. Thus, the user cannot accidentally select a particular target heart rate but must select an interval of at least 20 beats per minute through which his heart rate will be alternatively increased and decreased. User presses ENTER, or 9 sec total timeout accepts display value. Note: treadmill TARGET heart rates are LOW HR+5, and HIGH HR minus 10.
8. Display shows "HI SPEED 3.0" for a treadmill speed of 3 miles per hour ("5.0" for 5 kilometers in metric). "3.0" flashes for 6 sec, and steady for 3 sec. User adjusts value using +/− keys or 0–9 keys (entry may be 2.0 to 5.0 mph, or 3.0 to 8.0 kph). User presses ENTER, or 9 sec total timeout accepts display value or displays new HI SPEED value for 3 sec, and then accepts value). A new HI SPEED entry less than the present speed will cause the speed to slow to the HI SPEED. The HR Control program begins, and displays a heart with an up arrow 45. When the program decreases, the arrow 46 points down. If no heart rate is detected, the arrow is replaced by a "-- --".

PROGRAM OPERATION 1. 60 SEC WARM-UP. After the HR Control entries are selected and accepted by the microprocessor as described above, the incline holds steady, and the speed increases to 50% of "HI SPEED", or accepts the existing speed, whichever is greater. If present speed is greater than HI SPEED, treadmill should decrease to HI SPEED. Speed holds steady for 60 seconds.
2. WORKOUT 20 SEC INCREASING CHANGES (until the HIGH HR minus 10 target is reached or exceeded). The program first increases speed by 0.3 mph (or 0.5 kph) increments until the HI SPEED is reached. Then the incline is increased by 2% increments to 14% maximum. If the heart rate is still NOT achieved, the speed and incline will hold steady until the HIGH HR minus 10 target is reached, or the treadmill is manually changed.
3. User's actual heart rate will be displayed for 4 sec, in every 60 sec, when not in continuous heart rate display.
4. WORKOUT 20 SEC DECREASING CHANGES (until the LOW HR+5 target is reached or exceeded). The program will decrease the incline and then slow the speed (in same intervals as the "increases"), but go no slower than 2.0 mph (3 kph). If the LOW HR+5 heart rate is still NOT achieved, the speed and incline will hold steady. (If manually changed, increases will begin from there, when the target IS reached.)
5. The program continues to add to the workout data, and summarizes the workout when ended by pressing STOP twice, or once+timeout.
6. THE WORKOUT SUMMARY shows the display upper row for 6 sec, and then the lower row for 6 sec, twice, followed by "GOOD WORKOUT". Pressing STOP will end the summary.
7. Pressing the speed + or − keys 50 or the numeric/enter keys 44, or the incline keys 55, will increase or decrease the workout speed or incline, and the program will continue from there.
8. Pressing the HEART key 40 will hold the speed and incline steady, and display the heart rate prompts 1 and 2. "1" will give actual heart rate continuously (press HEART again for off) while in the HR Control program. "2" will display actual heart rate, and then display the Control Program prompts, allowing entries. A no signal "HRT RATE -- -- --" will return to the program, and hold the speed and incline steady. Pressing HEART will exit the prompts.
9. Pressing the STOP key will return the speed to 0, and PAUSE the program for a maximum of 30 sec. Pressing STOP again (or timeout) will end the program, and display the workout SUMMARY. Pressing START will continue the workout, but will display the HEART prompt options for "2", as before.

A significant feature of this invention is that the interval control microprocessor 25 is programmed to require the user to select a dynamic interval training program in which the user's heart rate is caused to continuously change so that during the exercise program, the heart rate never reaches a steady-state number of beats per minute. As noted above, if the user attempts to insert a target heart rate by selecting LOW HR and HIGH HR values which are the same or very close, this system automatically toggles within a pre-set minimum interval difference between high and low levels of 20 beats per minute (bpm) and the motor and incline are automatically controlled to cause the user's heart rate to continuously change. While in actual use the heart rate change in each 40 second cycle will typically be less than this pre-set interval, actual tests have shown that the heart rate will actually continuously change a minimum of about 5 beats per minute during each complete 40 second cycle.

EXAMPLE 2

Stationary Bicycle Operation

Operation of the heart rate interval control system with an exercise bicycle (see FIG. 6) is substantially as described above, except that the level is the resistance of a pair of rotating pedals. The program accepts lower and upper heart rate targets. After an initial warm-up, the program adjusts the pedaling resistance workout level to alternately move the user's heart rate near one target and then the other, providing an Interval Training Workout directed by the user's heart rate.

The program generally makes changes every 20 seconds, guided by the user's heart rate. If the RPM is at 40 or below, "PEDAL FASTER" will display, and the workout level will decrease by 1 at each 20 sec interval. If the heart rate signal is lost during the Control program, the program will hold the intensity level steady until the heart rate is received (or manual changes are keyed in). Preferably, no prompting is made to the user to reestablish heart monitoring, although communication with the user regarding the receipt or not of a valid heart rate signal is entirely within the scope of the invention. Chest strap users will continuously be monitored. Contact heart rate users must re-establish their heart rate periodically to continue HR Control adjustments. The program continues to add to any workout data already accumulated.

SELECTING HEART RATE INTERVAL CONTROL

1. User presses the HEART key at ANY time. Existing workout LEVEL will hold steady.
2. Display will show "1=HEART RATE" for 2 sec, then "2=HR CONTROL" for 2 sec, and repeat the cycle until a selection is made. A 16 sec timeout returns to the existing program.
3. Pressing "1" will display the standard heart rate prompts and heart rate continuously, until HEART is pressed again (off). If in HR Control, actual (no smart heart) will be displayed.
4. Pressing "2" will display the standard heart rate prompts, and show the actual heart rate for 6 sec. If no chest strap signal is detected and no contact is sensed within standard timeouts, the display will show "HRT RATE -- -- --" for 4 sec, and return back to the existing workout.
5. The program will display "AGE =". The user will press the numeric keys 41 on Panel 21 and press enter or time out and accept the entry. The programmed calculate a "60%" LOW HR default value from: (220−AGE)×60%. If no age is given within 9 sec, the program default will instead use the actual heart rate subtracting 10 bpm (acceptable LOW HR values are 90 to 160 bpm.). If the heart rate was 110, for example, the display would show "LOW HR=100."
6. The LOW HR value "100" initially flashes (½ sec on and ½ sec off) for 6 sec, and steady for 3 sec. User adjusts the value using +/− keys or 0–9 keys. User presses ENTER, or 9 sec total timeout accepts display value. SHIFT key has no response. HEART will exit to the existing workout.
7. The program calculates the "75%" HIGH HR default value from LOW HR×1.25. The value initially flashes for 6 sec, and steady for 3 sec. User adjusts the value using +/− keys or 0–9 keys. Acceptable HIGH HR values are 110to 180bpm. The minimum difference between the limits is 20 bpm. User presses ENTER, or 9 sec total timeout accepts display value. Note: bicycle TARGET heart rates are LOW HR+5, and HIGH HR minus 10.

8. Display shows "HI SPEED" and the speed flashes for 6 sec, and steady for 3 sec. User adjusts value using +/– keys or 0–9 keys. User presses ENTER, or 9 sec total timeout accepts display value or displays new HI SPEED value for 3 sec, and then accepts value). A new HI SPEED entry less than the present speed will cause the speed to slow to the HI SPEED. The HR Control program begins, and displays a heart with an up arrow. When the program decreases, the arrow points down. If no heart rate is detected, the arrow is replaced by a "-- --".

PROGRAM OPERATION 1. 60 SEC WARM-UP. After the HR Control entries are accepted (see "Selecting . . . " section), the pedaling resistance holds steady, and the speed increases to 50% of "HI SPEED", or accepts the existing setting, whichever is greater, for 60 seconds.
2. WORKOUT 20 SEC INCREASING CHANGES (until the HIGH HR minus 10 target is reached or exceeded). The program first increases speed by 0.5 level increments until the HI LEVEL is reached. If the heart rate is still NOT achieved, the pedaling speed and resistance will hold steady until the HIGH HR minus 10 target is reached, or the bicycle is manually changed.
3. User's actual heart rate will be displayed for 2 sec, in every 60 sec, when not in continuous heart rate display.
4. If the RPM reaches 40 or below, "PEDAL FASTER" will display, and the level will decrease by 1 at each 20 sec interval.
5. WORKOUT 20 SEC DECREASING CHANGES (until the LOW HR+5 target is reached or exceeded). The program will decrease the level, but go no lower than level 2. If the LOW HR+5 heart rate is still NOT achieved, the level will hold steady. If manually changed, increases will begin from there, when the target is reached.
6. Pressing the level + or – keys will increase or decrease the workout level, and the program will continue from there.
7. Pressing the HEART key 40 will hold the workout level steady, and display the heart rate prompts 1 and 2. "1" will give actual heart rate continuously (press HEART again for off), while in HR Control "2" will display actual heart rate, and then display the Control Program Prompts, allowing entries. A no signal "HRT RATE -- -- --" will return to the existing program.

Figure 3:
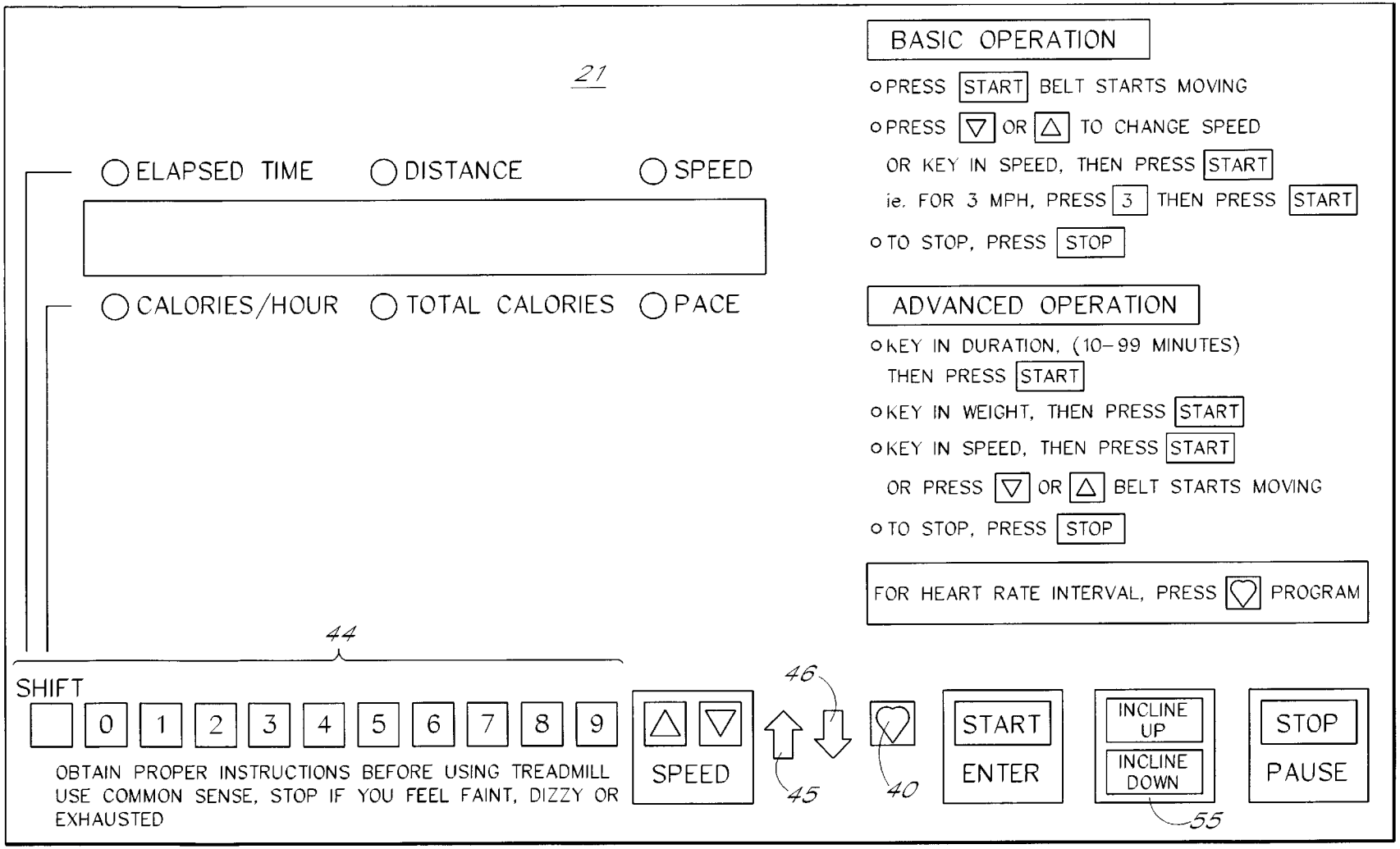
FIG. 3 is an enlarged view of the control panel and display of FIGS. 1 and 2.
Figure 7:
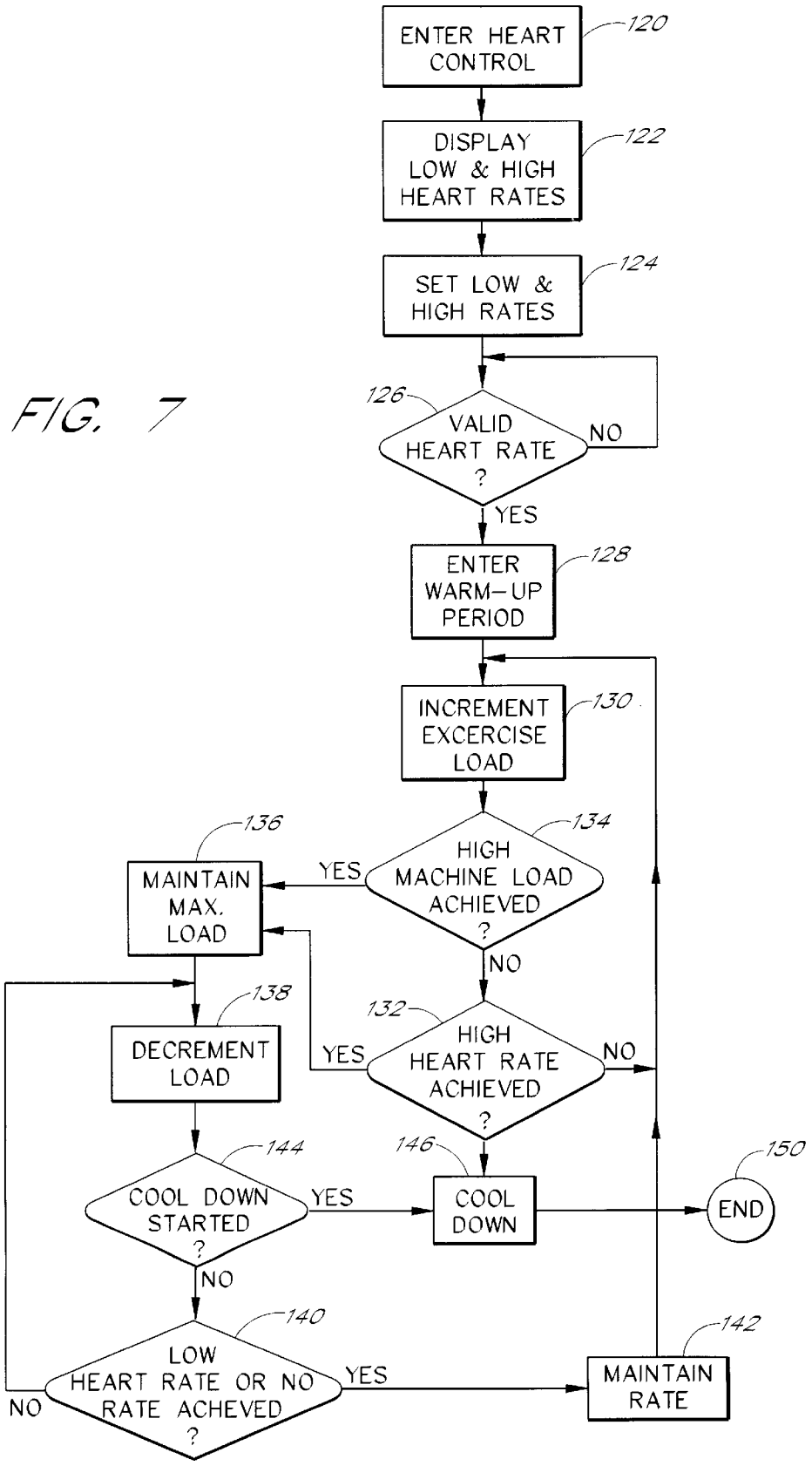
FIG. 7 illustrates a flow chart showing the operation of a programmed microprocessor in accordance with an alternative embodiment of the present invention.

FIG. 7 illustrates a flow chart showing the operation of the programmed microprocessor 25 in accordance with an alternative embodiment. In this embodiment, the interval heart rate control mode can be entered at any time by pressing a heart key 140, illustrated in the enlarged view of FIG. 3. The heart key is typically user accessible and displayed immediately in front of a user on the console or panel 20. When the hear key is pressed, display 21 will show a low and a high value for heart rate, typically in beats-per-minute. For example, low and high heart rates may be set between minimum and maximum, such as a minimum of 80 beats-per-minute and a maximum of 210 beats-per-minute. Within the range of permissible parameters, as may be determined by the mechanical performance of treadmill 10, the low and high value are selected by a user either by hitting an increment or decrement key 45, 46 on console 20, or entering a specific number on a keypad 44 which may be provided, as shown in FIG. 3.

For example, a low value may flash at a periodic rate such as 2 Hz for a predetermined period of time, such as 10 seconds, during which user 10 may input a different value than the default value, accept the last value entered in the machine, or a value retrieved from memory based on user selection. Thereafter, the high heart rate value may flash for 10 seconds, allowing a user the option of setting the high heart rate in the same manner.

In the preferred embodiment, the method will make exercise changes only when valid heart rate information is received. If control console 20 stops receiving information, no changes are made in control until a valid heart rate is detected.

The warm-up period is entered at step 128 wherein exercise load, work level or exercise rate starts the minimum machine setting predetermined for treadmill 10. This minimum setting may, but need not necessarily, be below the low setting set at step 124. While the heart rate information is being monitored, treadmill 10 will increase the load or work level at a periodic rate until the high heart rate target set in step 124 is achieved as determined at step 132. For example, every 30 seconds, the load or work level of treadmill 10 may be increased by five percent, or some other increment, until the high target heart rate is achieved, or alternatively, until the highest work load within the range of treadmill 10 is reached, whichever may be first.

If treadmill 10 reaches its maximum load or work level and user 12 has still not achieved the high target heart rate, as determined at step 134, treadmill 10 will maintain the maximum load for a predetermined time at step 136, for example 30 seconds, after which the load will begin to be decremented by predetermined increments at step 138 until the low heart rate is achieved as determined at step 140. When treadmill 10 transitions from the high heart rate to the low target heart rate, decrementing steps 138 are made every 30 seconds or other interval and rate. This cycle is continued until the low target heart rate is achieved after which the low rate is maintained at step 142 or until cool-down period has started as determined at step 144. If the timed program point for cool-down has been achieved, then the heart rate is ceased to be monitored at step 146 and the cool-down exercise phase is implement at step 146 as is conventional.

Alternatively, step 140 will determine if no heart rate is sensed within a predetermined timed period, and if so, this event will also be treated as the achievement of low heart rate, resulting in the maintenance of the then-achieved rate at step 142 until cool-down is initiated as determined at step 144 and implemented at step 146. This then represents one interval training cycle, which may then be repeated a number of times, either predetermined by program control or as selected by user 12.

The embodiment of FIG. 7 has been described generically in terms of machine load. In the case of a bicycle or stepper, for example, the machine load will be comprised of the actual physical force required to step or peddle the device. The speed of stepping or peddling is determined by the user in response to the load limited by the achieved heart rate as described.

In another embodiment, machine load can be comprised of parameters such as both speed and elevation, as is the case in a treadmill. In this case, step 134, for example, is comprised of a two-step determination. First, a determination is made whether or not treadmill 10 has reached a preset or user set high speed limit. The user, by personal preference or age, may wish to limit the speed of the treadmill to a comfortable or desired rate. If the high target heart rate is not achieved at step 132, then on the next cycle through step 134, the load is increased, not by increasing the speed, which has presumably reached the high speed limit, but by increasing the elevation of the treadmill, for example by two percent inclination increments on each cycle through step 134.

In the case where the load has been increased by increasing elevation of treadmill 10, then in the decrement step 138, the load is first decreased by decreasing elevation inclination before speed is decreased. Thereafter, speed is decreased by a predetermined increment, such as 0.5 miles-per-hour until the load heart rate is achieved at step 140, or no heart rate is sensed. In the case of a plurality of parameters for adjustment of machine load, neither parameter will be changed unless valid heart information is received.

Consider for example, a specific embodiment. For example, in FIG. 7, after selecting heart rate control at step 120, the user will be prompted to enter his or her weight, age and a duration time for their exercise with time-outs reverting to a track display in the event that any of this input parameters fail to be provided within a predetermine time. The track display is a symbolic depiction of a track around which the exercisers output is measured in laps. The default low heart rate is then determined, for example, by the formula 220− age×0.6. Exerciser 12 either accepts the default low rate or enters a new rate with a distinctive feedback beep for every change in the heart rate entered with, for example, 5 beats-per-minute being a minimum increment. The maximum rate, for example, of 199 beats-per-minute will be permitted with a second distinguishable tone provided as feedback to the user if an out-of-range value is attempted, in which case, the last value for the low target heart rate will be entered as a default. The high rate is then set at the low rate, but incremented at 5 beats-per-minute as a default value. In this case, the exerciser will then be cycled between the low and high interval targets within a narrow band of 5 beats-per-minute.

User 12 has the option to increase this heart rate range according to personal training experience and goals to any difference permitted between the low target rate and the maximum permitted rate of 199 beats-per-minute. Again, the first tone is provided with every change of the heart rate as the high target rate is set, with a second distinctive tone provided when an out-of-range value is attempted to be entered. If an out-of-range value is entered as the high target rate, then the last high target rate entered will appear as a default.

The high and low heart rates having thus been set, display unit 120 will then prompt for a high speed limit. As stated, the high speed limit can be arbitrarily set within the range of the machine at predetermined intervals and is arbitrarily selected by the users according to their own comfort and discretion. Therefore, having a high speed limit and low and high target rates set into the device, the process then begins with detection of a valid heart rate at step 126 and a warm-up at step 128, followed by the interval exercise described above. The warm-up period of step 128 may be practiced by accelerating the treadmill belt by 0.5 mile-per-hour increments through a predetermined time interval until 60 percent of the high speed limit set by user 12 has been reached. If valid heart rate information is not obtained at this point, console 12 will provide a display showing that it is still looking for a valid heart rate, and if within 20 seconds no heart rate is provided, display a message to the user that heart rate signal has failed to be detected and all further adjustments to speed or elevation of treadmill 10 will be stopped until a valid heart rate is obtained.

Once treadmill 10 does obtain a valid heart rate and warm-up period 28 completed according to conventional parameters, speed is increased every 30 seconds by 5 percent until the high speed target or high heart rate target is achieved. If the high speed has been achieved, but the high target rate has not been achieved, treadmill 10 will increase elevation by 2 percent grade inclination every 30 seconds until it reaches its highest elevation, or the high heart target rate has been received. At that point, the highest elevation and highest set speed will be maintained at step 36 for 30 seconds, and thereafter adjustments made to achieve the low heart target rate. Treadmill 10 then makes adjustments every 30 seconds by decreasing elevation by 2 percent grade decrements to zero elevation and then decreasing the speed by 0.5 mile-per-hour until the low target heart rate is achieved or the duration time limit reached. Decrementation continues until the cool-down period begins or no heart rate is sensed. Loss of heart rate will result in the display first searching for heart rate, and if no heart rate information is found, treadmill 10 will make no further adjustments in speed or elevation until it receives valid heart rate signals. The speed and elevation adjustments will continue as described, however, once valid heart rate information is established. Periodically, the methodology allows adjustment of the heart rate during exercise. If the user does not make an adjustment of the low or high limits, then the last set values will then be used as a default.

In the illustrated embodiment, the decrementation of the load will in the last 60 seconds of the program slow the belt to 60 percent of the speed achieved just prior to the last 60 seconds and lower the elevation to zero degrees regardless of the load point reach just prior to the 60 second point. Thereafter, the 30 second cool-down period begins, after which the belt comes to a stop and there is a summary of information displayed on display unit 20, such as the interval target heart rates with congratulatory or encouraging prompts to the user for a successful workout.

Many alterations and modifications may be made by those having ordinary skill in the art without departing from the spirit and scope of the invention.

For example, while the preferred embodiments described above allow the user to accept a default range of target heart rates or enter their own, alternative embodiment could store programs in memory. This would allow the user to retrieve a program already containing the user's preferred target heart rates, high speed or machine load and even workout duration.

In another embodiment, the time period between incremental parameters may also be varied. Also, the increments of machine load may vary from those disclosed in the preferred embodiments. For example, machine load parameters may be changed every 30 seconds in 2–5% increments.

Another embodiment may also maintain the machine load for a predetermined period of time after the user's high heart rate target has been reached. The same may occur each time the user's low heart rate has been reached.

Another embodiment of the invention would allow the user to enter a program duration. With a program duration entered, the invention may include a "cool-down" period in which the machine load is lessened but not stopped, allowing the user to avoid an abrupt end to the workout.

Other improvements and modifications will be readily apparent to those skilled in the art having reference to the detailed disclosure and drawings herein. Therefore, it should be understood that the illustrated embodiments have been set forth only for the purposes of example and that it should not be taken as limiting the invention in any way, except as defined by a fair reading of the following claims.

We claim:

1. A method for cardiopulmonary interval training with an exercise apparatus having a controllable load, comprising:

determining a high user heart rate for the user;

determining a first apparatus target heart rate for the user, corresponding to a first load setting wherein said first apparatus target heart rate is less than said high user heart rate by a predetermined offset;

determining a second apparatus target heart rate for the user, corresponding to a second load setting wherein said second apparatus target heart rate is less than said first apparatus target heart rate;

measuring the user's heart rate as the user exercises on the exercise apparatus;

increasing the load from the first load setting toward the second load setting over a predetermined period of time until the second apparatus target heart rate is achieved; and decreasing the load toward the first load setting over a predetermined period of time until the first apparatus target heart rate is achieved;

whereby cardiopulmonary interval training is obtained between said first and second apparatus target heart rates without significant overshoot in the user's heart rate above the high user heart rate.

2. The method of claim 1, further comprising maintaining said load constant for a second predetermined period of time when said second apparatus target heart rate is achieved.

3. The method of claim 1, further comprising maintaining said load constant for a second predetermined period of time when a maximum load of the exercise apparatus is achieved.

4. The method of claim 1, further comprising maintaining said load constant for a second predetermined period of time when said second apparatus target heart rate or a maximum load of the exercise apparatus is achieved, whichever occurs first.

5. The method of claim 1, further comprising temporarily maintaining said load constant whenever measurement of said user's heart rate is lost and thereafter continuing to increase or decrease said load when said user's heart rate is reobtained.

6. The method of claim 1, further comprising maintaining said load constant for a third predetermined period of time when said first apparatus target heart rate is achieved.

7. The method of claim 1, further comprising maintaining said load constant for a third predetermined period of time whenever the minimum load of the exercise apparatus is achieved.

8. The method of claim 1, further comprising maintaining said load constant for a third predetermined period of time whenever said first apparatus target heart rate or a minimum load of the exercise apparatus is achieved, whichever occurs first.

9. The method of claim 1, wherein said first and second apparatus target heart rates are separated by a predefined number of beats-per-minute.

10. The method of claim 1, where said steps of increasing said load and decreasing said load are cyclically repeated to provide a multiple of training intervals.

11. The method of claim 1, wherein the exercise apparatus is a treadmill having a first load setting determined by both speed and elevation adjustments and further comprising determining a maximum speed at which said user will exercise upon said treadmill, said load being increased by increments in said speed adjustment until said maximum speed is achieved.

12. The method of claim 11, further comprising maintaining said load constant whenever said user heart rate is no longer obtained.

13. The method of claim 11, further comprising increasing said load after said maximum speed has been achieved, if said second apparatus target heart rate has not been achieved, by incrementally increasing said elevation adjustment.

14. The method of claim 13, further comprising maintaining said treadmill at said maximum speed and a maximum elevation for a second predetermined period of time if said second apparatus target heart rate has not been achieved, otherwise terminating increase of speed or elevation adjustment when said second apparatus target heart rate has been achieved.

15. The method of claim 13, where decreasing said load comprises first decreasing said elevation adjustment of said treadmill, if any, and thereafter decreasing said speed adjustment of said treadmill until said first apparatus target heart rate is achieved.

16. An apparatus for providing cardiopulmonary interval training, comprising:

a controllable load for determining work output from a user;

a heart monitor for measuring the heart rate of said user; and a controller coupled to said load for receiving information representative of a high user heart rate, for determining a second apparatus target heart rate less than said high user heart rate and corresponding to a second load setting, for determining a first apparatus target heart rate corresponding to a first load setting for said user, and for receiving measured heart rate signals from said heart monitor, said controller increasing the load from the first load setting toward the second load setting until the second apparatus target heart rate is achieved and thereafter decreasing the load toward the first load setting until the first apparatus target heart rate is achieved;

whereby cardiopulmonary interval training between said first apparatus target heart rate and said second apparatus target heart rate is thereby provided.

17. The apparatus of claim 16, where said controller increases said load until said second apparatus target heart rate or maximum load capable for said apparatus is obtained and thereafter maintains said load at a fixed level for a predetermined period of time.

18. The apparatus of claim 16, wherein said controller maintains said load at its current value whenever said heart monitor ceases to obtain valid measured heart rate signals.

19. The apparatus of claim 16, wherein said controller decreases said load until said first apparatus target heart rate or minimum load capable for said apparatus is obtained and thereafter maintains said load at a fixed level for a predetermined period of time.

20. The apparatus of claim 16, wherein said exercise machine is a treadmill and said load has a speed adjustment and elevation adjustment mechanism.

21. The apparatus of claim 20, wherein said controller increases or decreases said speed adjustment of said treadmill after a user-determined maximum of speed is obtained and thereafter increases or decreases set elevation adjustment of said treadmill only after said user-maximum or device minimum speed has been achieved.

* * * * *